US006805142B2

(12) United States Patent
Kim et al.

(10) Patent No.: US 6,805,142 B2
(45) Date of Patent: Oct. 19, 2004

(54) PASSAGEWAY STRUCTURE OF DISHWASHER

(75) Inventors: Jin Woong Kim, Kwangmeong-si (KR); Si Moon Jeon, Seoul (KR); Tae Hee Lee, Seoul (KR); Dae Yeong Han, Seoul (KR)

(73) Assignee: LG Electronics Inc., Seoul (KR)

( * ) Notice: Subject to any disclaimer, the term of this patent is extended or adjusted under 35 U.S.C. 154(b) by 331 days.

(21) Appl. No.: 09/964,471

(22) Filed: Sep. 28, 2001

(65) Prior Publication Data

US 2002/0014260 A1 Feb. 7, 2002

(30) Foreign Application Priority Data

May 7, 2001 (KR) ..... 2001/24529

(51) Int. Cl.[7] ..... B08B 3/02
(52) U.S. Cl. ..... 134/104.1; 134/111; 134/104.2
(58) Field of Search ..... 134/104.1, 104.4, 134/111, 56 D, 57 D, 104.2

(56) References Cited

U.S. PATENT DOCUMENTS 3,810,480 A * 5/1974 Smith et al.
4,972,861 A * 11/1990 Milocco et al.
5,165,433 A * 11/1992 Meyers
5,377,707 A * 1/1995 Young, Jr.
5,542,443 A * 8/1996 Yuira et al.
5,609,172 A * 3/1997 Chang et al.
5,730,805 A * 3/1998 Bertsch et al.
5,762,080 A * 6/1998 Edwards et al.
5,900,070 A * 5/1999 Jarvis et al.
6,432,216 B1 * 8/2002 Thies

FOREIGN PATENT DOCUMENTS

KR 1070104200000 6/1997
KR 1020000009783 2/2000

OTHER PUBLICATIONS

European Patent Office 222,306.*

* cited by examiner

*Primary Examiner*—Frankie L. Stinson
(74) *Attorney, Agent, or Firm*—Fleshner & Kim, LLP

(57) ABSTRACT

Disclosed is a dishwasher including, a circulating pump for pressing and then supplying wash liquid, an injection arm for permitting the wash liquid pressed and supplied from the circulating pump to be injected by a predetermined passage structure, an underdrain container for collecting the wash liquid injected from the injection arm and supplying the collected wash liquid to the circulating pump, during a washing stage, a soil collecting chamber having a micro filter with a fine mesh for ramifying and finely filtering the wash liquid supplied from the circulating pump and returning the same to the underdrain container, during the washing stage, a drain pump for allowing the wash liquid to be drained through a drain passage which is extended from the underdrain container, and through a connecting passage which is extended from the soil collecting chamber and connected to the drain passage, during a draining stage. The present invention has advantages of preventing pollution of newly supplied wash liquid from being aggravated, since foreign materials filtered by the micro filter in the washing stage is smoothly discharged in the draining stage, and removing troublesome process of additionally removing the foreign materials after dish washing, since the micro filter is self-purified, thereby improving efficiency in washing and convenience in use.

4 Claims, 6 Drawing Sheets

PASSAGEWAY STRUCTURE OF DISHWASHER

BACKGROUND OF THE INVENTION

1. Field of the Invention

The present invention relates to a dishwasher, and more particularly, to a dishwasher having a micro filter equipped with a self-purifying function placed at a passage of a dishwasher to filter wash liquid having a high concentration of soil particles.

2. Background of the Related Art

In general, dishwashers are machines for automatically washing dishes by infecting wash liquid which contains with a detergent. Dishwashers having two dish accommodating spaces, namely, two-stage dishwashers include, as shown in FIG.1, a case 10, upper and lower racks 20 which are installed on the case 10 to accommodate dishes, upper and lower injection arms 30 which are installed on a lower side of each rack 20, a circulating pump 40 for pressing and supplying wash liquid to the respective arms 30, a drain pump 50 for draining the wash liquid, and filtering means for filtering the wash liquid.

Here, the respective arms 30 are supported by an arm holder 34 which is connected to a feed pipe 32 so as to be horizontally rotated, and a plurality of injection nozzles 301 are installed on an upper surface of the injection arms facing the respective racks 20.

In the circulating pump 40, a discharge slot is connected to the feed pipe 32 and the injection arms 30 to supply the wash liquid, and an inlet is connected to an underdrain container 60 which is comprised in the filtering means. The filtering means includes the underdrain container 6C which is provided on a lower part of a bottom surface at the inside of the case 10, and a first filter (rough mesh filter) 62 and a second filter (fine mesh filter) 64, which are installed within the underdrain container 60. The underdrain container 60 is opened toward a so-called washing space on an upper surface thereof, and connected to the circulating pump 40 on one side thereof and the drain pump 50 on a lower side thereof.

Here, the second filter 64 is configured in a shape of a pipe connected with the drain pump 50 on a lower side thereof. The first filter 62 is shaped like a filter net being provided within the second filter 64.

Operation of the aforesaid dishwashers of the conventional art is roughly divided into two stages, that is to say, a washing stage and a draining stage. In the washing stage, the washing operation is carried out in a manner that the wash liquid formed with mixture of water and detergent is pressed and supplied to the upper and lower arms 30 by the circulating pump 40, and injected to dishes d placed in the racks 20 by the injection nozzles 301.

At this time, the wash liquid injected by the injection arms 30 is collected in the underdrain container 60 on the bottom, and supplied to the injection arms 30 again by the circulating pump 40. This process is called a circulation operation. During the course of the circulation, such soil as food residues separated from the dishes d are filtered by the first and second filters 62 and 64, so as to prevent aggravated pollution of the wash liquid (see FIG.2).

When the washing stage is finished with the lapse of a predetermined period of time, the draining stage is then initiated. During the draining stage, the wash liquid is drained by the operation of the drain pump 50. As illustrated in FIG. 2, the soil with large particles is filtered by the first filter 62 and then remains within the first filter 62, thereby preventing a drain outlet from being clogged. The soil with smaller particles that passed through the first filter 62 are filtered at the second filter 64, and then discharged together with the wash liquid through the drain outlet 501 or the drain pump 50.

If the draining stage is finished and the operation of the drain pump 50 is stopped, the wash liquid still remains in a drain pipe 54 which connects the drain outlet 501 with a soil ditch. Sometimes the residual wash liquid flows backward into an inside of the dishwasher. In an attempt to prevent a backward flow of the residual wash liquid, a check valve may be installed on the drain outlet 501.

The check valve 70 prevents the backward flow of the residual wash liquid in by allowing the wash liquid in the drain pipe 54 to flow only from the drain outlet 501 to the soil ditch. The washing and draining stages are performed once during what is called one round of water filling. General, three or four rounds of water filling are conducted during one dish washing cycle. The washing and draining stages are accordingly performed, thereby enhancing efficiency in dish washing.

The conventional art, however, has a disadvantage of decreasing efficiency in washing, since a small particle soil is adhered to the second filter 64 because of structural feature of the second filter (fine mesh filter) 64, and not all of the adhered soil is discharged during the draining stage, causing a newly supplied wash liquid to be polluted.

The soil filtered by the first and second filters 62 and 64 should be removed after the washing is finally finished, however, in the conventional art the small particle soil filtered by the second filter 64 is difficult to remove although the larger particle soil filtered by the first filter 62 can be more easily removed.

SUMMARY OF THE INVENTION

Accordingly, the present invention is directed to a passage structure of a dishwasher that substantially obviates one or more problems due to limitations and disadvantages of the related art.

An object of the present invention is to provide a passage structure of a dishwasher, which can filter wash liquid in a more efficient manner by employing a predetermined passage on which a micro filter is installed and enabling the micro filter to have a self-purification capacity.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

These and other objects are satisfied by a passage structure of a dishwasher including, a circulating pump for pressing and then supplying wash liquid, an injection arm for permitting the wash liquid pressed and supplied from the circulating pump to be injected by a predetermined passage structure, an underdrain container for collecting the wash liquid injected from the injection arm and supplying the collected wash liquid to the circulating pump, during a washing stage, a soil collecting chamber having a micro filter with a fine mesh for ramifying and finely filtering the wash liquid supplied from the circulating pump and returning the same to the underdrain container, during the washing stage, a drain pump for allowing the wash liquid to be drained through a drain passage which is extended from the underdrain container, and through a connecting passage which is extended from the soil collecting chamber and connected to the drain passage, during a draining stage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Figure 1:
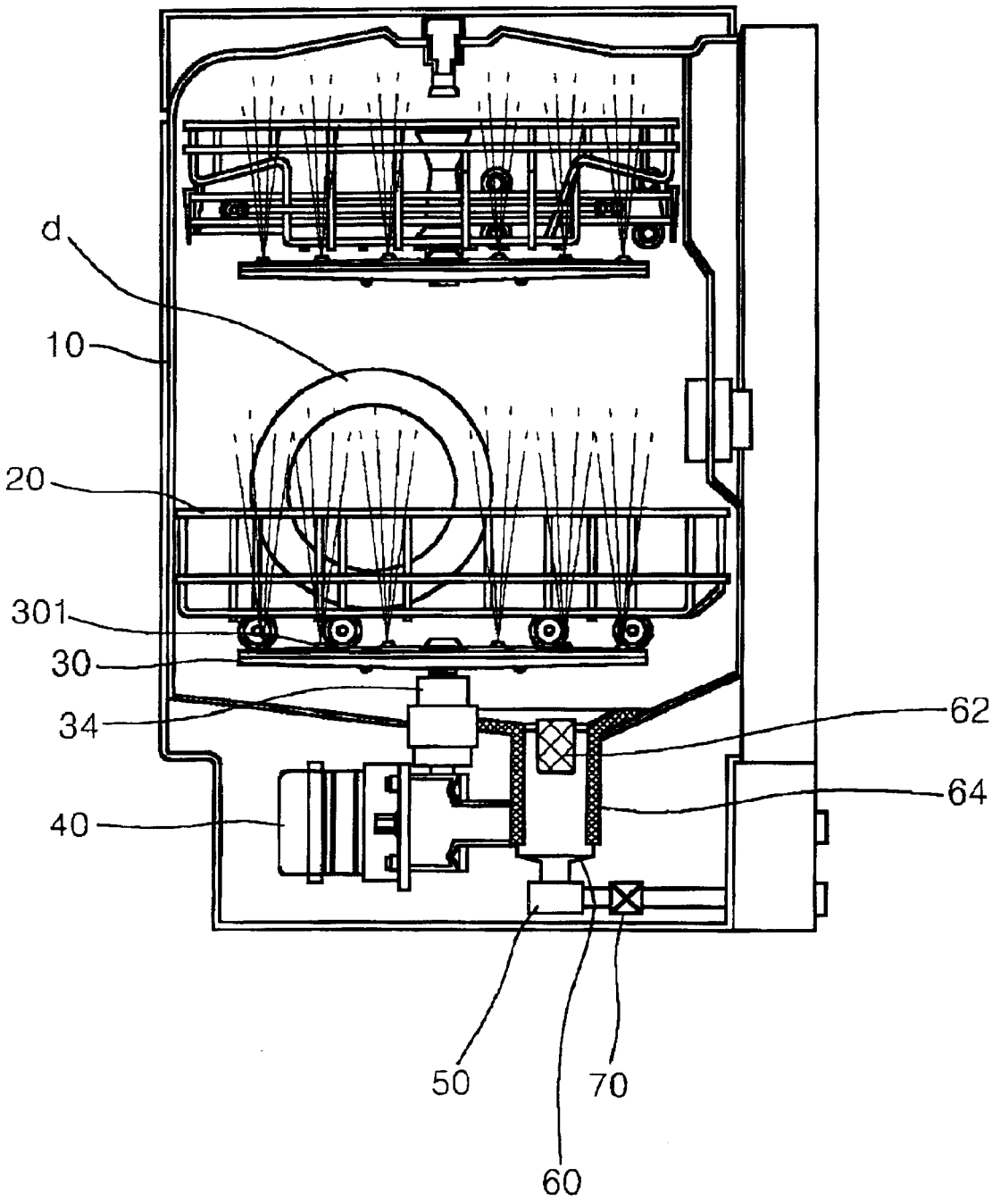
FIG. 1 is a sectional view showing a construction of a general dishwasher.
Figure 2:
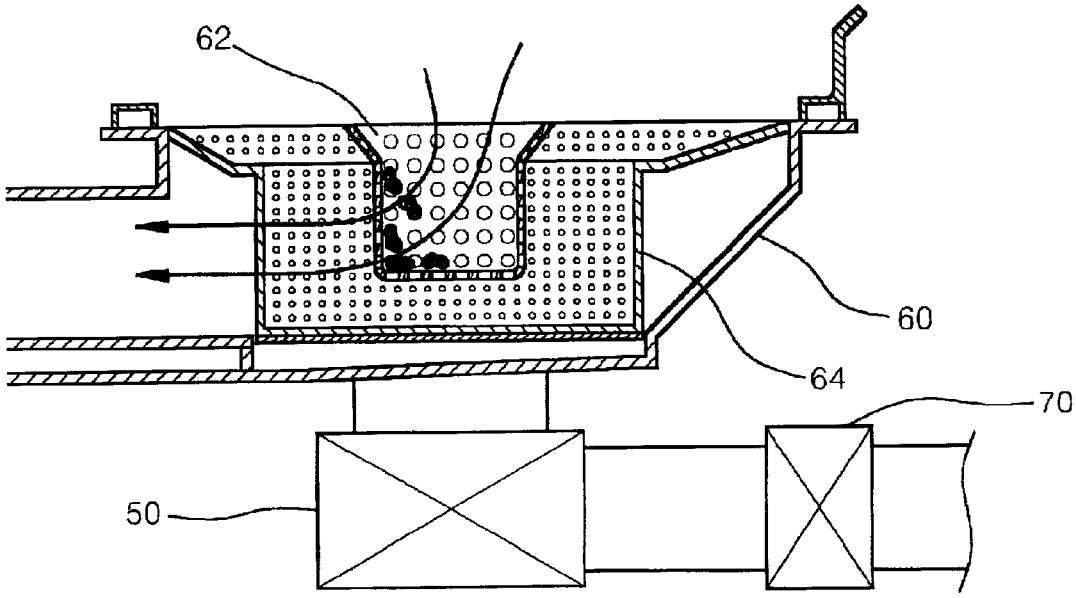
FIG. 2 is a sectional view illustrating a filtering operation of a conventional filtering means applied to the general dishwasher.

Reference will now be made in detail to the preferred embodiments of the present invention, examples of which are illustrated in the accompanying drawings. Similar reference numerals identify corresponding parts.

Figure 3:
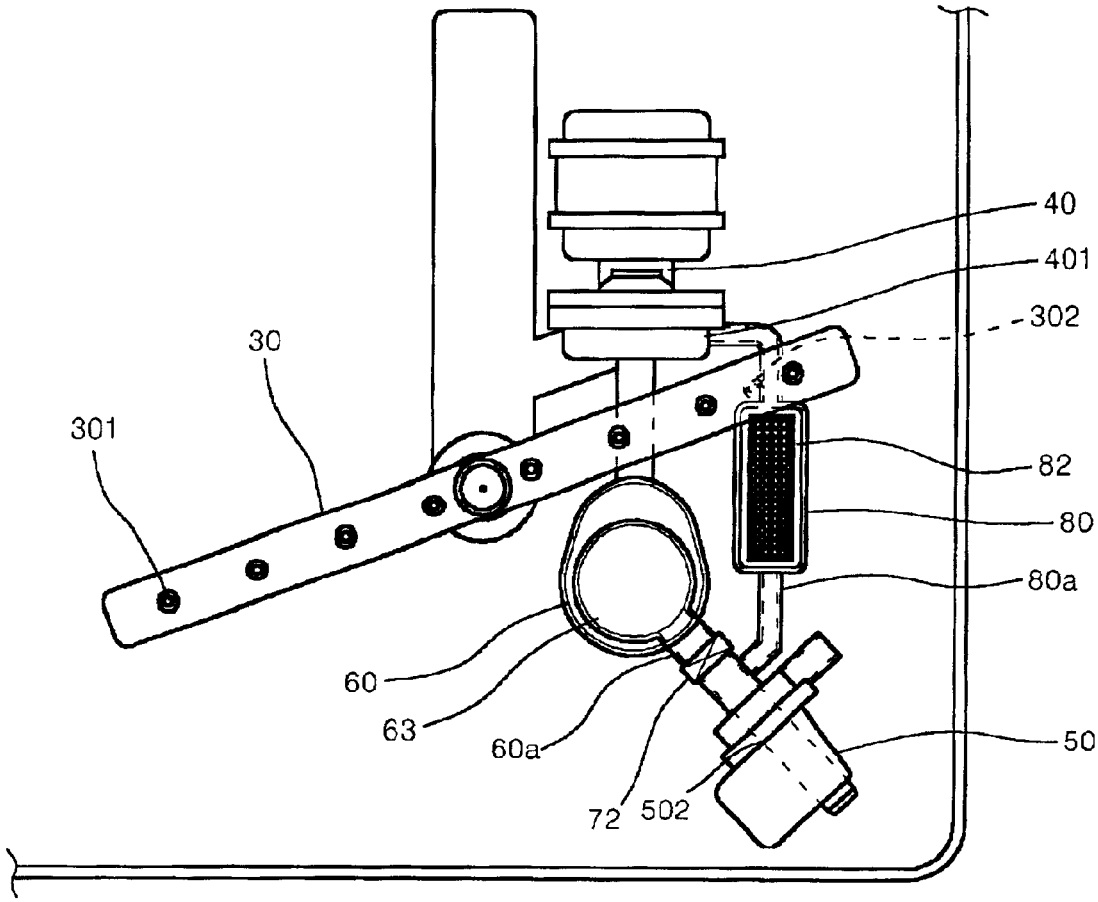
FIG. 3 is a plan view showing a construction of essential parts of a dishwasher according to a preferred embodiment of the present invention.

Referring to FIG. 3, a filtering means employed in a dishwasher according to a preferred embodiment of the present invention includes a net filter 63 being installed in an underdrain container 60, a soil collecting chamber 80 (see FIG. 4) which is provided on a bottom surface within the case 10 and connected to a discharge slot 401 of a circulating pump 40 and to an inlet 502 of a drain pump 50, a micro filter 82 placed on an upper surface of the soil collecting chamber 80, and an auxiliary injection nozzle 302 which is installed on a lower surface of an injection arm 30 and injects wash liquid to the micro filter 82. Here, the net filer 63 is a sort of rough mesh filter and filters soil having larger particles, whereas the micro filter 82 is a sort of fine mesh filter relative to a net filter 63 and filters soil having smaller particles.

The auxiliary nozzle 302 is placed with a predetermined distance from a center of rotation of the injection arm 30, so as to pass an upper side of the micro filter 82 when the injection arm 30 is rotated, and also formed on a lower side of the injection arm 30 so as to strike an upper surface of the micro filter 82.

A check valve 72 is provided on a drain passage 60*a* that connects the underdrain container 60 to the drain pump 50 to prevent wash liquid from flowing backward into the underdrain container 60. The check valve 72 is placed at a position close to the underdrain container 60 based on a connecting passage with the soil collecting chamber 80.

Operation of the dishwasher according to the preferred embodiment will be explained on the basis of wash liquid filtering operation. Initially, the wash liquid filtering operation according to the preferred embodiment is divided into a main filtering operation through the net filter 63 and an auxiliary filtering operation through the micro filter 82. The main filtering operation is carried out in such a manner that all of the wash liquid discharged from the injection arm 30 passes through the net filter 63 during one circulation cycle, whereby the soil having larger particles is filtered.

Then, the auxiliary filtering operation is carried out in such a manner that a partial volume of the wash liquid discharged from the circulating pump 40 is flowed into the soil collecting chamber 80 through the discharge slot 401, and then upwardly ejected through the micro filter 82, whereby the fine soil which has not been filtered by the net filter 63 is filtered through the micro filter 82.

If the wash liquid is repeatedly circulated for a predetermined number of times, the auxiliary filtering operation has the same effect that the total volume of wash liquid is filtered through the micro filter 82. Accordingly the fine soil contained in the wash liquid is entirely filtered.

In the injection arm 30, the wash liquid is upwardly injected from a plurality of injection nozzles 301 which face upward to wash dishes and the wash liquid is downwardly injected from the auxiliary nozzles 302 which face downward. Since the downwardly injected wash liquid strikes an upper part of the micro filter 82 intermittently, soil particles adhered on a lower surface of the micro filter 82 are removed, thereby a self-purification function is achieved. Therefore, the soil collected in the soil collecting chamber 80 is maintained in a floated condition within the soil collecting chamber 80 by virtue of the aforesaid self-purification function preventing the soil from being adhered on the micro filter 82, which may partially clog the micro filter.

Figure 4A:
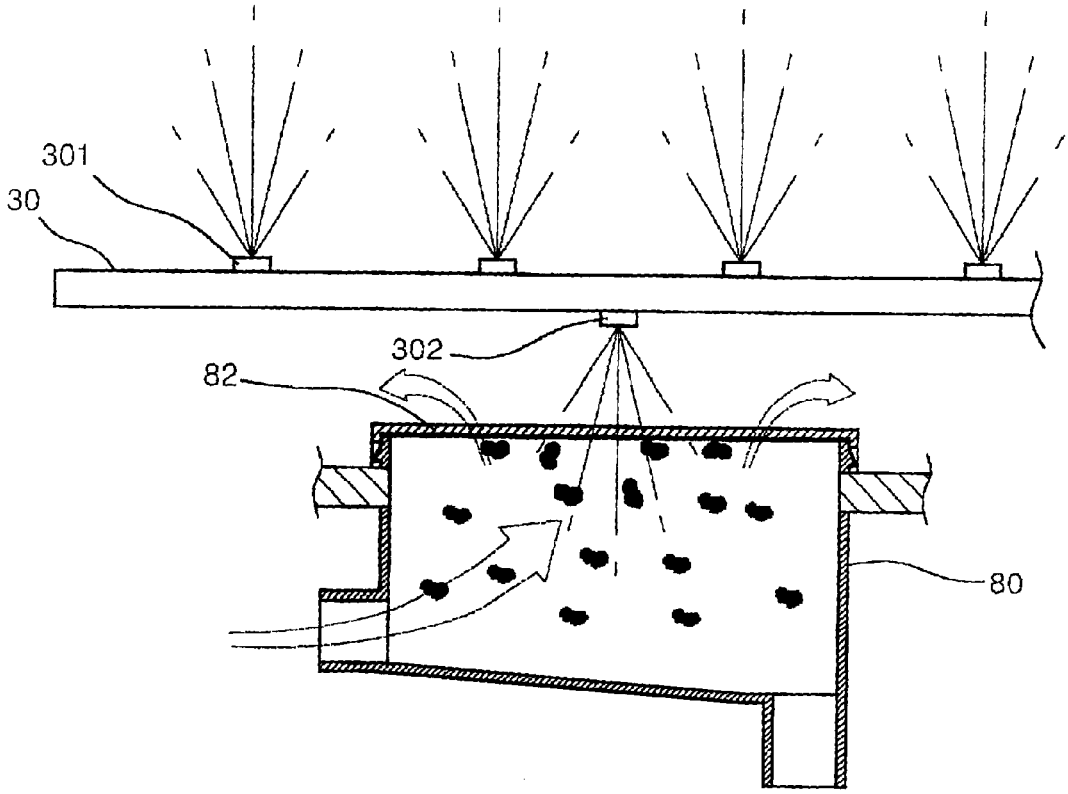
FIG. 4*a* and FIG. 4*b* are sectional views of a filtering operation and a draining operation of a micro filter employed to the dishwasher according to the preferred embodiment of the present invention.
Figure 4B:
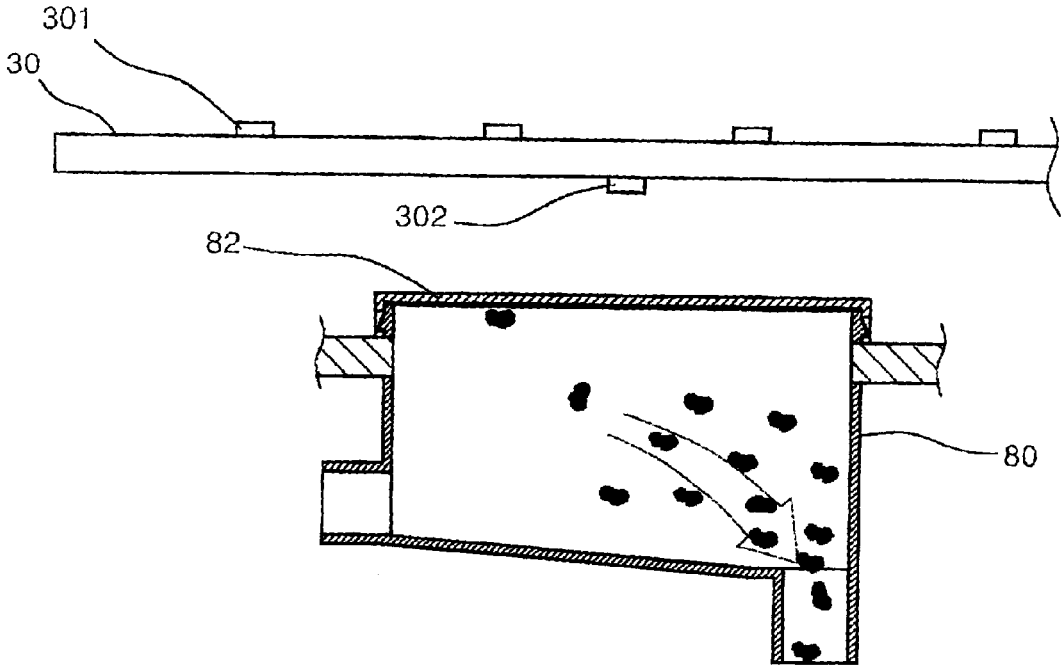

When the draining stage is conducted after the end of the washing stage, as shown in FIG. 4*b*, the soil particles collected in the soil collecting chamber 80 is drawn together with the wash liquid into the drain passage 60*a* by the drain pump 50 via the connecting passage 80*a* before being discharged. As a result, the micro filter 82 does not need to be separately cleaned.

According to the preferred embodiment of the present invention, in the course of the first washing or the repeated circulation of wash liquid after the end of the draining stage, the check valve 72 prevents the wash liquid remaining on the drain passage 60*a* and the soil collecting chamber 80 from flowing backward into the underdrain container 60. In particular, the reason why the check valve 72 is installed near the underdrain container 60 based on the connecting passage 80*a* on the drain passage 60*a* is that it prevents the soil collected in the soil collecting chamber 80 from being flowing backward into the underdrain container 60.

Meantime, in the event that the volume of residual wash liquid is heavy, the backward flow of the wash liquid into the underdrain container 60 is prevented with the aid of the check valve 72. However, the wash liquid may still flow backward toward the soil collecting chamber 80, causing the wash liquid to be polluted.

Figure 5:
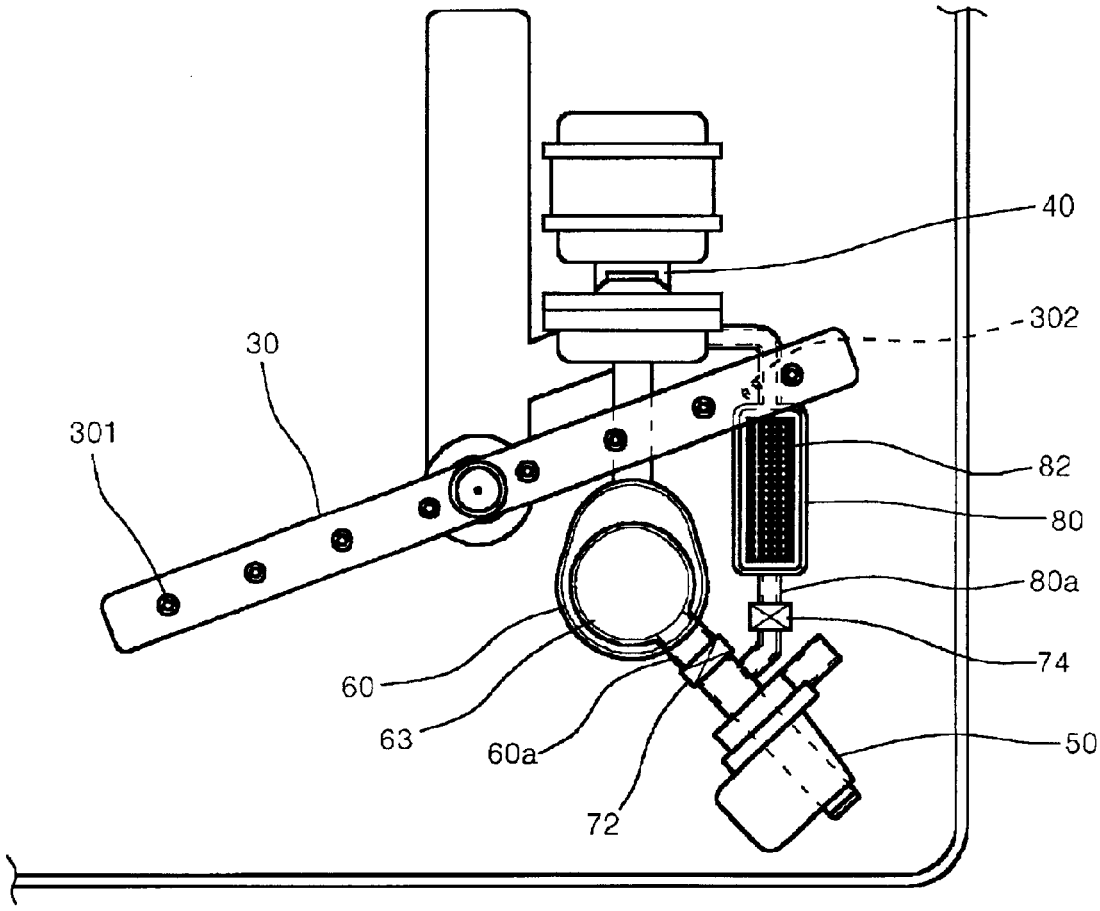
FIG. 5 is an enlarged plan view showing a construction of essential parts of a dishwasher according to another preferred embodiment of the present invention.

In order to prevent the wash liquid from flowing backward, still another preferred embodiment of the present invention, as shown in FIG. 5, further employs an auxiliary check valve 74 placed in the connecting passage 80*a* which connects the soil collecting chamber 80 with the drain passage 60*a*. Even if the volume of the residual wash liquid is large, the auxiliary check valve 74 can block the wash liquid from flowing backward into the soil collecting chamber 80.

Referring to FIG. 4 or FIG. 5, the drain pump 50 may be integrally formed with the circulating pump 40, without being separated from each other. Even if a single motor is used and the combination drainage/circulating pump is coaxially formed, when the respective passages are connected to the pertinent positions of the same pump, the operation of the system will not be effected regardless of whether the drain pump 50 is integrated with the circulating pump 40.

As stated above, the dishwasher according to the present invention has an advantage of preventing newly supplied wash liquid from being polluted, since the soil particles filtered by the micro filter in the washing stage are smoothly discharged in the draining stage. And also since the micro filter is self-purified, troublesome process of additionally removing the soil particles after dish washing has been eliminated, thereby improving efficiency in washing and convenience in use.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A dishwasher comprising:

a case, a rack being installed on the case to accommodate dishes, an injection arm being installed on a lower side of the rack, a circulating pump for pressing and supplying wash liquid to the injection arm, a drain pump for draining the wash liquid, and filtering means for filtering the wash liquid, wherein the filtering means includes:

an underdrain container being installed on a lower part of a bottom surface within the case and being connected to an inlet of the drain pump, and a net filter being installed on the underdrain container, a soil collecting chamber being installed on a bottom surface of the case and being connected to a discharge slot of the circulating pump and the inlet of the drain pump and a micro filter being installed on an upper surface of the soil collecting chamber, and an auxiliary nozzle being installed on a lower surface of the injection arm to inject the wash liquid to an upper surface of the micro filter.

2. The dishwasher of claim 1, further comprising a check valve which is formed on a drain passage connected from the underdrain container to the drain pump to prevent the wash liquid from being flowing backward into the underdrain container.

3. The dishwasher of claim 2, wherein the check valve is placed at a position close to the underdrain container based on a connecting passage with the soil connecting chamber.

4. The dishwasher of claim 1, further comprising an auxiliary check valve which is formed on the connecting passage connecting the soil collecting chamber and the drain passage to prevent the wash liquid from being flowing backward into the soil collecting chamber.

* * * * *